US008061984B2

(12) United States Patent
Kuzdzal et al.

(10) Patent No.: US 8,061,984 B2
(45) Date of Patent: Nov. 22, 2011

(54) DRY GAS BLOW DOWN SEAL

(75) Inventors: Mark Joseph Kuzdzal, Allegany, NY (US); Harry Francis Miller, Allegany, NY (US); Glenn R. Grosso, Olean, NY (US); Martin D. Maier, Allegany, NY (US); David J. Peer, Olean, NY (US)

(73) Assignee: Dresser-Rand Company, Olean, NY (US)

( * ) Notice: Subject to any disclaimer, the term of this patent is extended or adjusted under 35 U.S.C. 154(b) by 459 days.

(21) Appl. No.: 12/419,086

(22) Filed: Apr. 6, 2009

(65) Prior Publication Data

US 2010/0254811 A1 Oct. 7, 2010

(51) Int. Cl.
*F01D 11/02* (2006.01)

(52) U.S. Cl. ..... 415/229; 415/230; 415/231; 415/110

(58) Field of Classification Search ..... 415/231, 415/229, 230, 109, 110, 111; 277/303
See application file for complete search history.

(56) References Cited

U.S. PATENT DOCUMENTS

| | | | | |
|---|---|---|---|---|
| 5,292,138 | A * | 3/1994 | Glynn et al. | 277/422 |
| 5,304,032 | A * | 4/1994 | Bosna et al. | 415/200 |
| 5,412,977 | A * | 5/1995 | Schmohl et al. | 73/46 |
| 5,718,560 | A | 2/1998 | Lorenzen | |
| 6,524,059 | B1 | 2/2003 | Nogiwa | |
| 6,655,693 | B2 | 12/2003 | Hosanna et al. | |
| 6,789,804 | B2 | 9/2004 | Wilhelm | |
| 6,802,689 | B2 | 10/2004 | Nogiwa | |
| 6,854,735 | B2 * | 2/2005 | Sarshar et al. | 277/355 |
| 7,014,192 | B2 | 3/2006 | Takahashi et al. | |
| 7,144,015 | B2 | 12/2006 | Roberts-Haritonov et al. | |
| 2003/0049118 | A1 * | 3/2003 | Bruno et al. | 415/1 |
| 2004/0013522 | A1 * | 1/2004 | Burdgick | 415/230 |
| 2004/0156722 | A1 * | 8/2004 | Chu et al. | 415/231 |
| 2005/0242515 | A1 | 11/2005 | Brooks et al. | |
| 2007/0147988 | A1 | 6/2007 | Ito et al. | |
| 2009/0290971 | A1 * | 11/2009 | Shamseldin et al. | 415/1 |
| 2010/0183439 | A1 * | 7/2010 | Ren | 415/230 |
| 2010/0322765 | A1 * | 12/2010 | Markwalder et al. | 415/230 |
| 2011/0189013 | A1 * | 8/2011 | Alfes | 415/230 |

FOREIGN PATENT DOCUMENTS

| | | | |
|---|---|---|---|
| EP | 1128101 | A2 | 8/2001 |
| EP | 1326037 | A1 | 7/2003 |
| GB | 1404701 | A | 9/1975 |

OTHER PUBLICATIONS

United Kingdom Search Report issued for Application No. GB1004541.7 dated Jun. 30, 2010, 3 pages.

* cited by examiner

*Primary Examiner* — Matthew Landau
*Assistant Examiner* — Robert Bachner
(74) *Attorney, Agent, or Firm* — Edmonds & Nolte, PC

(57) ABSTRACT

A sealing assembly configured to seal a rotating shaft of a turbo machine having a high pressure process gas, comprising a housing defining a bore configured to receive the rotating shaft and sealing assembly, wherein the housing is mounted to a casing of the turbo machine; a first sealing stage comprising a single dry gas seal and configured to blow down the high pressure process gas to a lower pressure; a labyrinth seal mounted longitudinally outward from the first sealing stage; and a second sealing stage mounted longitudinally outward from the labyrinth seal, wherein the second sealing stage comprises a tandem dry gas seal having a primary dry gas seal and a secondary dry gas seal axially spaced with an intermediate labyrinth seal.

20 Claims, 3 Drawing Sheets

DRY GAS BLOW DOWN SEAL

BACKGROUND

In a typical turbo machine seal assembly, tandem dry gas seals consisting of a primary and a secondary gas seal, are often used to eliminate process gas leakage to the atmosphere. The tandem dry gas seal has pressure limits well below the turbo machine's ability. In high pressure applications, however, to operate properly the tandem gas seal must receive "blown-down" process gas (a low-pressure process gas that has been significantly reduced in pressure by a previous "blow down" seal). In conventional operations, a tooth or damper labyrinth seal is typically used as the blow down seal and configured to blow down high-pressure process gas to a level that the tandem gas seal can accept. Using a labyrinth seal, however, has demonstrated significant inefficiencies in the form of total flow and machinery power losses. Therefore, in high-pressure applications, there is a need for an alternative to the tooth or damper labyrinth seal used to blow down the high-pressure process. Instead, what is needed is a low-leakage sealing technology capable of handling higher delta pressures.

SUMMARY

A sealing assembly for forming a seal between a rotating shaft and a casing of a turbo machine having a high-pressure process gas is herein disclosed. The sealing assembly may include a housing defining a bore configured to receive the rotating shaft and sealing assembly, wherein the housing is mounted adjacent the casing; a high-pressure seal radially coupled proximate to an outer edge of the casing, wherein the high-pressure seal is configured to blow down the high pressure process gas to a first pressure lower than the high pressure; a high-pressure labyrinth seal mounted longitudinally outward from the high-pressure seal and configured to partially restrict the flow of the process gas along the rotating shaft and separate the process gas from the high-pressure seal; a single dry gas blow-down seal mounted longitudinally outward from the high-pressure labyrinth seal and configured to blow down the process gas from the first lower pressure to a second pressure lower than the first pressure; a labyrinth seal mounted longitudinally outward from the single dry gas blow-down seal; a tandem dry gas seal mounted longitudinally outward from the labyrinth seal, wherein the tandem dry gas seal comprises a primary dry gas seal and a secondary dry gas seal axially spaced with an intermediate labyrinth seal; and a separation seal mounted longitudinally outward from the tandem dry gas seal.

Also disclosed herein is another sealing assembly configured to form a seal on a rotating shaft of a turbo machine having a high pressure process gas. The sealing assembly may include a first sealing stage comprising a single dry gas seal extending circumferentially around the rotating shaft and configured to blow down the high pressure process gas to a lower pressure; a labyrinth seal mounted longitudinally outward from the first sealing stage and extending circumferentially around the rotating shaft; and a second sealing stage mounted longitudinally outward from the labyrinth seal and extending circumferentially around the rotating shaft, wherein the second sealing stage comprises a tandem dry gas seal having a primary dry gas seal and a secondary dry gas seal axially spaced with an intermediate labyrinth seal.

Lastly, a method configured to form a seal on a rotating shaft of a turbo machine having a high pressure process gas is herein disclosed. The method may include blowing-down the high pressure gas to a lower pressure using a single dry gas seal extending circumferentially around the rotating shaft; providing a labyrinth seal mounted longitudinally outward from the single dry gas seal and extending circumferentially around the rotating shaft; and blowing-down the lower pressure gas to about atmospheric pressure using a tandem dry gas seal mounted longitudinally outward from the labyrinth seal and extending circumferentially around the rotating shaft, wherein the tandem dry gas seal comprises a primary dry gas seal and a secondary dry gas seal axially spaced with an intermediate labyrinth seal.

BRIEF DESCRIPTION OF THE DRAWINGS

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
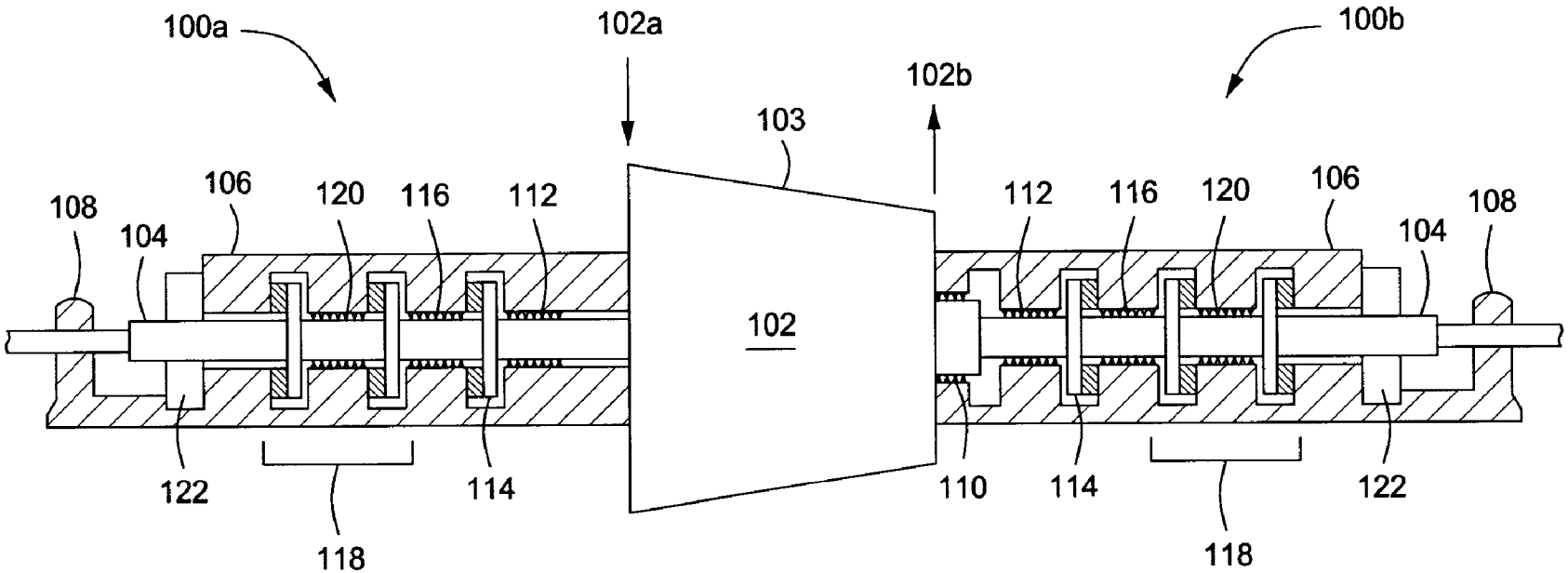
FIG. 1 is a partially sectioned side view of an exemplary seal system according to one or more aspects of the present disclosure.

It is to be understood that the following disclosure describes several exemplary embodiments for implementing different features, structures, or functions of the invention. Exemplary embodiments of components, arrangements, and configurations are described below to simplify the present disclosure, however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope.

Referring now to the drawings in detail, wherein like numbers are used to indicate like elements throughout, there is illustrated in FIG. 1 seal assemblies 100*a,b* according to one or more aspects of the present disclosure. The seal assemblies 100*a,b* may be used in conjunction with a turbo machine 102 enclosed in a casing 103 and having a low-pressure gas entry side 102*a* and a high-pressure gas exit side 102*b*.In an exemplary embodiment, the turbo machine 102 may consist of a high-pressure turbo-compressor. The turbo machine 102 may also include a rotor shaft 104 configured to extend through the turbo machine 102 and exit one or both sides of the casing 103 into a housing 106. The rotor shaft 104 may be journalled at each end by employing suitable bearings 108. In alternative embodiments, the casing 103 and the housing 106 may include the same overall structure, or otherwise the casing 103 and housing 106 may each be enclosed by a separate overall casing structure.

As illustrated in FIG. 1, one seal assembly 100*a* may be installed on the low-pressure gas entry side 102*a*, and the other seal assembly 100*b* may be installed on the high-pressure gas exit side 102*b*.In alternative embodiments, however, an exemplary seal assembly 100 as discussed herein may be utilized effectively on a single sided turbo machine (e.g., machines of the overhang type).

Relative to the housing 106, the rotor shaft 104 may be sealed via a series of seals to reduce process gas leakage from the inner area of the turbo machine 102. In particular, the turbo machine 102 requires a seal assembly 100*a,b* configured to prevent process gas from escaping the turbo machine casing 102 and housing 106, thereby entering the atmosphere. For example, in certain operations involving toxic or explosive gas under pressure, the seal assembly 100*a,b* must be designed to prevent the dangerous gas from reaching the surrounding area, thereby causing volatile and possibly dangerous situations.

In an exemplary embodiment, the seal assembly 100*b* on the gas exit side 102*b* may include a high-pressure seal 110, a high-pressure labyrinth seal 112, a single dry gas blow-down seal 114, a labyrinth seal 116, a tandem dry gas face seal 118 including an intermediate labyrinth seal 120, and a separation (barrier) seal 122. Each seal (collectively 110, 112, 114, 116, 118, 120, and 122) may extend circumferentially around the rotating shaft 104 and be sequentially mounted longitudinally outward relative to the housing 106. The seal assembly 100*a* on the gas entry side 102*a* may be similar to the seal assembly 100*b* on the gas exist side 102*b*, excepting the need for a high-pressure seal 110.

Figure 2:
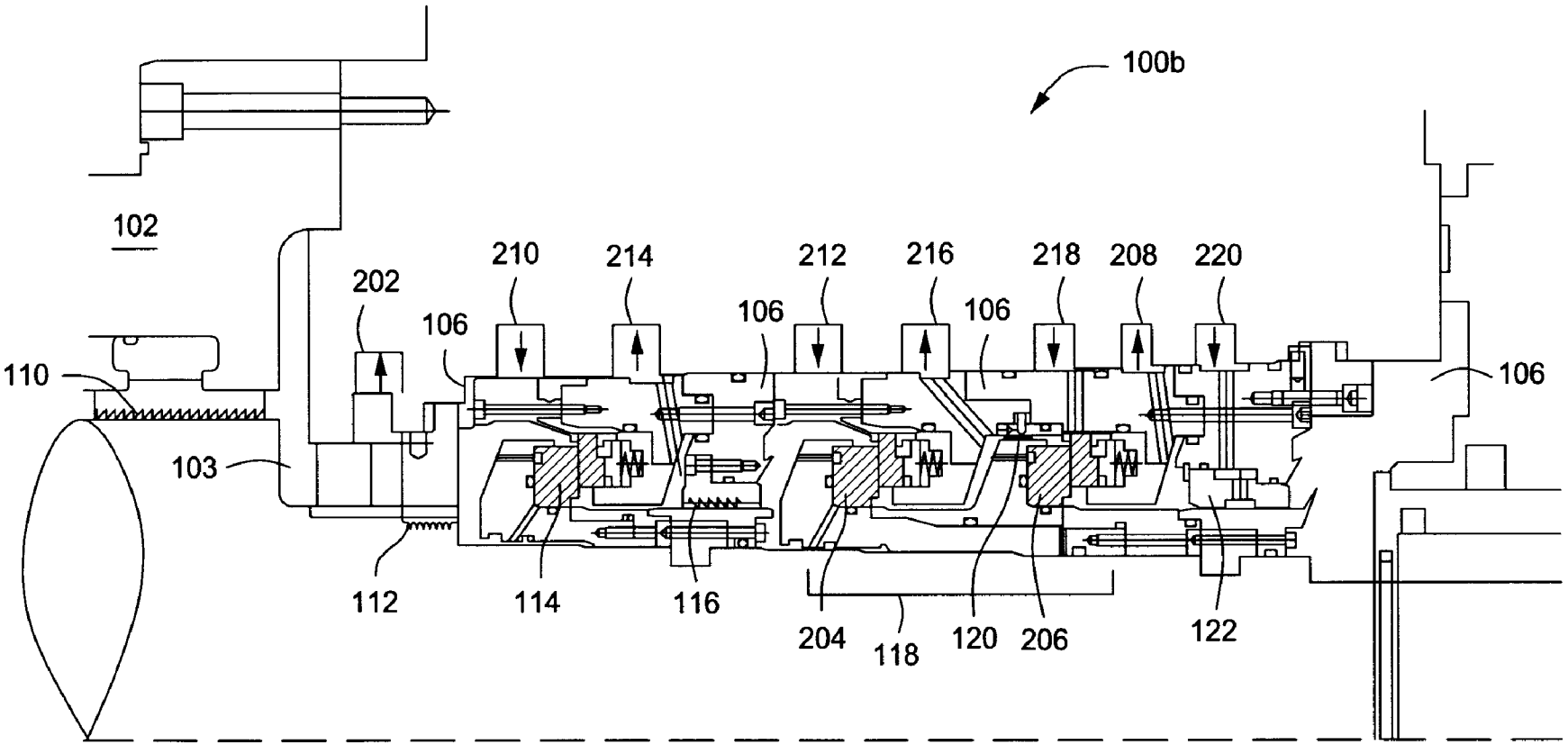
FIG. 2 is a quarter sectional view of a portion of the exemplary seal system of FIG. 1 according to one or more aspects of the present disclosure.

Referring to FIG. 2, illustrated is an exemplary embodiment of the sealing assembly 100*b*.As illustrated, the high-pressure seal 110 may be situated on the high-pressure gas exit side 102*b* of the turbo machine 102, and radially coupled to an outer edge of the interior of the turbo machine casing 103. The high-pressure seal 110 may be used to reduce the pressure of any process gas escaping the casing 103 to a lower inner-stage pressure. This may be done to create a delta pressure that serves to balance axial thrust forces generated inside the turbo machine 102. In one embodiment, a portion of this reduced-pressure process gas may be collected via conduit 202 and re-injected at gas entry side 102*a* to be re-pressurized by the turbo machine 102. The high-pressure labyrinth seal 112, located coaxially adjacent to the high-pressure seal 110, may be configured to separate any escaping process gas from the high-pressure seal 110.

Traditionally, a labyrinth-type seal has been employed coaxially adjacent the high-pressure labyrinth seal 112 and configured to blow down the high-pressure process gas to a level that a tandem dry gas seal 118 can accept. However, in high-pressure, low-flow applications, using the traditional labyrinth-type blow-down seal may cause up to 10% efficiency losses in power and total process flow of the machinery. According to the present disclosure, to decrease these efficiency losses, the blow-down process may instead be handled by a single dry gas blow-down seal 114. It has been shown that using a single dry gas blow down-seal may reduce total efficiency loss from 10% to about 2 - 3%, and even less than about 1% in some applications.

Therefore, an exemplary embodiment of the present disclosure may include the combination of a single dry gas blow-down seal 114 and a tandem dry gas face seal 118; thus taking advantage of the current tandem experience yet still efficiently reducing blow-down efficiency losses. This combination is not necessarily configured as a triple dry gas seal with a single drive pin. Instead, the seals 114, 118 may each include separate drive pins and separate shear rings to restrain axial forces and improve reliability by reducing the probability of a "domino-like" seal failure scenario, a common occurrence in tandem dry gas seal operations.

Still referring to FIG. 2, the tandem dry gas face seal 118 may be located coaxially adjacent the labyrinth seal 116. In an exemplary embodiment, the tandem dry gas face seal 118 may include a primary dry gas seal 204 and a secondary dry gas seal 206 with an intermediate labyrinth seal 120 interposed therebetween.

During typical operation of a dry gas face seal, a portion of the high-pressure process gas is cleaned and introduced to the gas seal to help maintain a high-pressure sealing effect, and also to prevent potential contamination of the seals. Prior to cleaning, this process gas may contain foreign matter such as dirt, iron filings, and other solid particles which can contaminate the seals. Therefore, cleaned seal gas, including filtered process gas or an inert gas from an external source, may be injected at each gas seal at a predetermined pressure higher than the pressures in the preceding inner-areas of the housing in order to block process gas leakage. In operation, the cleaned gas may be pressurized by a small reciprocating compressor, or may utilize pressurized gas from an alternative turbo machine application.

In exemplary operation of the present disclosure, a portion of cleaned seal gas may be injected via conduit 210 at a pressure in excess of the pressure incident in the casing 103. The resulting pressure differential may impede the exit of the high-pressure, potentially hazardous gas through the high-pressure labyrinth seal 112, and force the process gas leakage and a portion of the cleaned seal gas out conduit 202 to be re-injected into the process stream, possibly at the low-pressure gas entry side 102*a* (see FIG. 1). Portions of any residual leakage through the single dry gas seal 114 may be collected via blow down primary vent 214 for use in alternative applications. For example, collected residual leakage may be redirected to a separate, higher-pressure turbo machine to be further processed to higher pressures.

Likewise, cleaned seal gas may be injected at the tandem dry gas face seal 118 in a similar fashion. In particular, cleaned seal gas may be injected via conduit 212 between the labyrinth seal 116 and the primary gas seal 204 at a pressure in excess of the pressure incident in blow down primary vent 214. In an exemplary embodiment, the majority of the seal gas injected via conduit 212 may flow across the labyrinth seal 116 and into a seal gas vent via blow down primary vent 214. However, a small portion of the seal gas may flow across the primary gas seal 204 as leakage, which may either be collected or discharged to flare via the tandem primary vent 216.

In an exemplary embodiment, the primary gas seal 204 may be configured to absorb the full pressure drop between the conduit 212 and a secondary vent 208 by reducing the process gas pressure to at or near atmospheric pressure. During normal operation, the primary gas seal 204 absorbs the total pressure drop to the turbo machine 102 vent system, and the secondary gas seal 206 serves as a backup to allow safe shutdown of the turbo machine 102 in the event of a primary gas seal 204 failure. In other words, as long as the leakage through the primary gas seal 204 is minimal, the secondary gas seal 206 may operate on idle since it only has to overcome a small pressure difference.

Still referring to FIG. 2, in order to impede the flow of process or seal gas across the intermediate labyrinth seal 120, an intermediate gas may be injected via conduit 218, between the intermediate labyrinth seal 120 and the secondary gas seal 206. The intermediate gas may include, without limitation, an inert gas such as nitrogen, but alternatively may include a clean hydrocarbon gas. The intermediate gas may be injected at a pressure slightly higher than atmospheric, thereby creating a pressure differential configured to counter the further progress of process gas or seal gas leakage across the intermediate labyrinth seal 120. The injection of intermediate gas may further serve to "sweep" the process gas leakage through the tandem primary vent system 216, but may also impede process gas leakage out of the tandem secondary vent 208. As a result, only a small portion of intermediate gas may flow across the secondary gas seal 206 which may then be harmlessly discharged out the tandem secondary vent 208.

In an exemplary embodiment, separation gas, such as nitrogen (possibly from the same source as the intermediate gas), may be injected into the separation (barrier) seal 122 via conduit 220. Injecting separation gas into the separation seal 122 may prevent the further migration of any escaping process gas into the bearing housing 106 and also prevent lubrication oil from contaminating the dry gas seals 114, 204, 206. In one embodiment, the separation seal 122 may be a labyrinth-type seal, but may also be a bushing-type carbon ring barrier seal.

Figure 3:
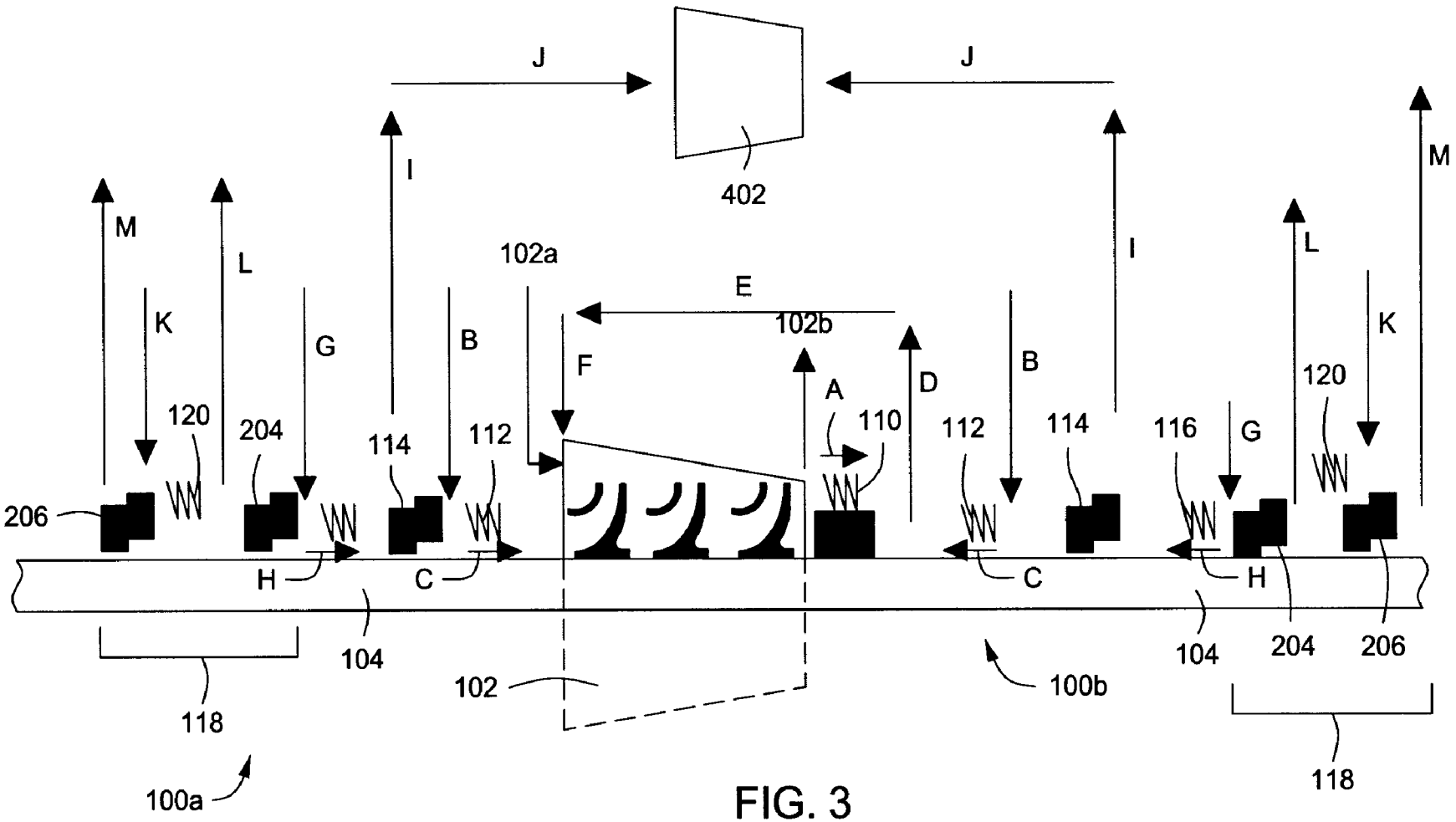
FIG. 3 is a side view schematic of an exemplary seal system according to one or more aspects of the present disclosure.

As further explanation of the foregoing sealing assembly 100*b*, the following exemplary embodiment of operation is given. Referring to FIG. 3, a gas may be introduced into a turbo machine 102 at input 102*a*, wherein the turbo machine 102 may be configured to compress the gas to a high pressure, reaching approximately 761 bar (approx. 11037 psi). Once compressed, the gas may subsequently be discharge via output 102*b*.While the bulk of the compressed gas is properly discharged via output 102*b*, a small portion of process gas at about 761 bar may leak out through minute gaps between the rotor shaft 104 and the turbo machine 102.

As illustrated in FIG. 3, the rotor shaft 104 may be sealed via at least one sealing assembly 100*a,b* configured to prevent process gas effusion from the inner area of the turbo machine 102 to the atmosphere. A high-pressure seal 110, adjacent the turbo machine 102 on the gas output side 102*b*, may be configured to reduce the pressure to the suction pressure of the turbo machine 102 to an inner-stage pressure of approximately 484 bar (approx. 7020 psi). In particular, as shown at arrow A, the high-pressure seal 110 may reduce the leakage pressure out of the turbo machine 102 from about 761 bar to about 484 bar.

To prevent further process gas leakage, a seal gas may then be injected at arrow B between a high-pressure labyrinth seal 112 and a single dry gas seal 114. The seal gas, possibly including a portion of clean process gas, may be injected at a pressure slightly higher than about 484 bar, in particular, about 485 bar (approx. 7034 psi). Since the injection pressure of the seal gas at arrow B is higher than the reduced pressure resulting from the high-pressure seal 110, the seal gas may act to prevent leakage across the high-pressure labyrinth seal 112, and instead force process gas through the inner labyrinth seal 112, as shown at arrow C. At a pressure of approximately 485 bar, this process gas may then be re-directed, as shown by arrows D, E, and F, and directly re-introduced at input 102*a* into the turbo machine 102 for re-processing.

In operation, however, a small portion of the seal gas may flow across the single dry gas seal 114 as leakage. In an exemplary embodiment, the single dry gas seal 114 may be configured to blow down the pressure to a pressure that can be handled by a tandem dry gas seal 118. In particular, the single dry gas seal may reduce the pressure of the process gas from approximately 484 bar to approximately 202 bar (approx. 2930 psi).

The tandem dry gas seal 118 may include a primary dry gas seal 204 and a secondary dry gas seal 206, having an intermediate labyrinth seal 120 interposed therebetween. To prevent leakage across the primary dry gas seal 204, seal gas at a pressure of about 203 bar (approx. 2944 psi) may be injected at arrow G between the labyrinth seal 116 and the primary dry gas seal 204. Since the seal gas injection pressure at arrow G is slightly higher than the pressure resulting from the single dry gas seal 114 blow down, the seal gas may force fluid flow across the labyrinth seal 116, as shown by arrow H. In an exemplary embodiment, process gas forced in the direction of arrow H at a pressure of about 202 bar may be re-directed to a separate, higher-pressure, turbo machine 402 application, as shown by arrows I and J.

However, a small portion of the seal gas may flow across the primary gas seal 204 as leakage. In an exemplary embodiment, the primary gas seal 204 may be designed to absorb the full pressure injected at arrow G. In other words, the primary gas seal 204 may be configured to seal a pressure of about 202 bar to at or near atmospheric pressure. The secondary gas seal 206, therefore, may act as a backup in the event of a primary gas seal 204 failure.

To remove any residual process gas leakage through the primary gas seal 204, an intermediate gas, typically nitrogen, may be injected at a pressure of about 2-3 bar (approx. 29-44 psi) between the intermediate labyrinth seal 120 and the secondary gas seal 206, as shown at arrow K. Since the injection at arrow K is above atmospheric pressure, the intermediate gas may prevent residual seal or process gas, if any, from flowing across the intermediate labyrinth seal 120. Instead, the injected seal gas at arrow K may redirect any residual seal or process gas either back into the process stream or out to flare via arrow L. In some instances, however, a small portion of intermediate gas may also flow across the secondary gas seal 206 where it may be harmlessly discharged to the atmosphere via arrow M.

The foregoing has outlined features of several embodiments so that those skilled in the art may better understand the detailed description that follows. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

We claim:

1. A sealing assembly configured to form a seal between a rotating shaft and a casing of a turbo machine having a high-pressure process gas, comprising:

a housing defining a bore configured to receive the rotating shaft and sealing assembly, wherein the housing is mounted adjacent the casing;

a high-pressure seal radially coupled proximate to an outer edge of the casing, wherein the high-pressure seal is configured to reduce the pressure of the high pressure process gas to a first pressure lower than the high pressure;

a high-pressure labyrinth seal mounted longitudinally outward from the high-pressure seal and configured to partially restrict the flow of the process gas along the rotating shaft and separate the process gas from the high-pressure seal;

a single dry gas blow-down seal mounted longitudinally outward from the high-pressure labyrinth seal and configured to blow down the process gas from the first lower pressure to a second pressure lower than the first pressure;

a labyrinth seal mounted longitudinally outward from the single dry gas blow-down seal;

a tandem dry gas seal mounted longitudinally outward from the labyrinth seal, wherein the tandem dry gas seal comprises a primary dry gas seal and a secondary dry gas seal axially spaced with an intermediate labyrinth seal; and a separation seal mounted longitudinally outward from the tandem dry gas seal.

2. The sealing assembly of claim 1, further comprising a first conduit configured to deliver a first seal gas pressure between the high-pressure labyrinth seal and the single dry gas blow-down seal, wherein the first seal gas pressure is greater than the first pressure, thereby inhibiting the process gas from passing through the high-pressure labyrinth seal.

3. The sealing assembly of claim 2, wherein residual process gas leakage through the single dry gas blow-down seal may be removed via a blow down primary vent.

4. The sealing assembly of claim 1, further comprising a second conduit configured to deliver a second seal gas pressure between the labyrinth seal and the primary seal, wherein the second seal gas pressure greater than the second pressure thereby inhibiting the process gas from passing through the labyrinth seal.

5. The sealing assembly of claim 4, wherein residual process gas leakage through the primary seal may be collected or removed via a tandem primary vent.

6. The sealing assembly of claim 1, further comprising a third conduit configured to deliver an intermediate gas between the intermediate labyrinth seal and the secondary seal at a pressure greater than atmospheric pressure.

7. The sealing assembly of claim 6, wherein intermediate gas leakage across the secondary seal is discharged out the tandem secondary vent.

8. The sealing assembly of claim 6, wherein the intermediate gas is nitrogen.

9. The sealing assembly of claim 1, wherein the single dry gas blow-down seal and the tandem dry gas seal are each configured with separate drive pins and separate shear rings to restrain axial forces.

10. A sealing assembly configured to form a seal on a rotating shaft of a turbo machine having a high pressure process gas, comprising:

a first sealing stage comprising a single dry gas seal extending circumferentially around the rotating shaft and configured to blow down the high pressure process gas to a lower pressure;

a labyrinth seal mounted longitudinally outward from the first sealing stage and extending circumferentially around the rotating shaft; and a second sealing stage mounted longitudinally outward from the labyrinth seal and extending circumferentially around the rotating shaft, wherein the second sealing stage comprises a tandem dry gas seal having a primary dry gas seal and a secondary dry gas seal axially spaced with an intermediate labyrinth seal.

11. The sealing assembly of claim 10, further comprising a first conduit configured to deliver a first seal gas pressure between the labyrinth seal and the primary dry gas seal, wherein the first seal gas pressure is greater than the lower pressure thereby inhibiting the process gas from passing through the labyrinth seal.

12. The sealing assembly of claim 10, further comprising a vent configured to remove residual process gas leakage through the primary dry gas seal.

13. The sealing assembly of claim 10, further comprising a second conduit configured to deliver an intermediate gas between the intermediate labyrinth seal and the secondary dry gas seal at a pressure greater than atmospheric.

14. The sealing assembly of claim 13 wherein the intermediate gas is nitrogen.

15. The sealing assembly of claim 10 wherein the single dry gas seal and the tandem dry gas seal are each configured with separate drive pins and separate shear rings to restrain axial forces.

16. A method of sealing a rotating shaft of a turbo machine having a high pressure process gas, comprising:

blowing-down the high pressure gas to a lower pressure using a single dry gas seal extending circumferentially around the rotating shaft;

providing a labyrinth seal mounted longitudinally outward from the single dry gas seal and extending circumferentially around the rotating shaft; and blowing-down the lower pressure gas to about atmospheric pressure using a tandem dry gas seal mounted longitudinally outward from the labyrinth seal and extending circumferentially around the rotating shaft, wherein the tandem dry gas seal comprises a primary dry gas seal and a secondary dry gas seal axially spaced with an intermediate labyrinth seal.

17. The method of claim 16, further comprising delivering a seal gas between the labyrinth seal and the primary dry gas seal, wherein the seal gas is delivered at a pressure greater than the lower pressure, thereby inhibiting the process gas from passing through the labyrinth seal.

18. The method of claim 16, further comprising delivering an intermediate gas between the intermediate labyrinth seal and the secondary dry gas seal, wherein the intermediate gas is delivered at a pressure greater than atmospheric.

19. The method of claim 18, wherein the intermediate gas is nitrogen.

20. The method of claim 16, wherein the single dry gas seal and the tandem dry gas seal are each configured with separate drive pins and separate shear rings to restrain axial forces.

* * * * *